US006279539B1

(12) United States Patent
Graves et al.

(10) Patent No.: US 6,279,539 B1
(45) Date of Patent: Aug. 28, 2001

(54) HYDRAULICALLY ACTUATED FUEL INJECTOR WITH COLD START FEATURES

(75) Inventors: Jeffrey D. Graves, Chenoa; Martin A. Lehman, Washington, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/295,174

(22) Filed: Apr. 20, 1999

(51) Int. Cl.[7] ..... F02M 41/00
(52) U.S. Cl. ..... 123/459; 123/458
(58) Field of Search ..... 123/446, 447, 123/458, 459; 251/48, 51; 239/88, 89, 90, 91, 92, 585.1

(56) References Cited

U.S. PATENT DOCUMENTS

| | | | |
|---|---|---|---|
| 3,758,071 | 9/1973 | Anderson | 251/139 |
| 4,392,612 | 7/1983 | Deckard | 239/88 |
| 4,470,545 | 9/1984 | Deckard | 239/88 |
| 4,540,122 | 9/1985 | Teerman | 239/88 |
| 4,572,433 | 2/1986 | Deckard | 239/88 |
| 4,618,095 | 10/1986 | Spoolstra | 239/90 |
| 4,883,252 | 11/1989 | Mesenich | 251/129.18 |
| 5,011,113 | 4/1991 | Stobbs | 239/88 |
| 5,143,291 * | 9/1992 | Grinsteiner | 239/88 |
| 5,213,083 * | 5/1993 | Glassey | 123/447 |
| 5,234,024 | 8/1993 | Stoltman | 137/495 |
| 5,375,576 | 12/1994 | Ausman | 123/446 |
| 5,517,972 * | 5/1996 | Stockner | 123/496 |

FOREIGN PATENT DOCUMENTS

WO 93/07382 4/1993 (WO) .

* cited by examiner

*Primary Examiner*—Henry C. Yuen
*Assistant Examiner*—Mahmoud Gimie
(74) *Attorney, Agent, or Firm*—Liell & McNeil

(57) ABSTRACT

A hydraulically actuated fuel injector includes an injector body which has an outer surface. An armature cavity is defined by the injector body and a solenoid. The solenoid includes an armature, which is positioned within the armature cavity. Attached to the armature and positioned in the injector body is a valve member that defines a centerline. A plurality of evacuation passages which extend from the armature cavity to the outer surface are defined by the injector body. The armature and the evacuation passages are positioned on opposite sides of a plane that is oriented perpendicular to the centerline.

19 Claims, 5 Drawing Sheets

HYDRAULICALLY ACTUATED FUEL INJECTOR WITH COLD START FEATURES

TECHNICAL FIELD

The present invention applies generally to hydraulically actuated fuel injectors and more specifically to hydraulically actuated fuel injectors with features to aid in performance at cold start.

BACKGROUND ART

Fuel injectors which utilize engine lubricating oil as actuation fluid are sometimes subject to performance diminutions at cold start due to viscous oil flowing into an armature cavity defined by the injector body and a solenoid. During a cold start, the highly viscous cold oil can inhibit the movement of the armature. In turn, injector performance can be adversely affected by the slowing down and/or restricted movement of the armature. One method for dealing with this problem is taught in U.S. Pat. No. 5,375,576 to Ausman et al. and involved positioning an o-ring seal in the fuel injector to prevent viscous oil from flowing into the armature cavity. Additionally, the poppet valve and sleeve in these previous fuel injectors were machined to tight clearances to aid in prevention of viscous oil flow into the armature cavity. By preventing the flow of cold oil into the armature cavity, the performance problems associated with viscous oil surrounding the armature during cold start can be avoided. Although the sealing and clearance solutions of Ausman have worked well for years, geometrical and spatial constraints do not always allow for the implementation and use of these solutions. Thus, in some fuel injectors a different solution must be found to alleviate the problems associated with cold start.

The present invention is directed to overcoming one or more of the problems described above and to improving fuel injector performance at cold start.

SUMMARY OF THE INVENTION

A hydraulically actuated fuel injector includes an injector body which has an outer surface. An armature cavity is defined by the injector body and a solenoid, which includes a coil. The solenoid also includes an armature which is positioned within the armature cavity. Attached to the armature and positioned in the injector body is a valve member that defines a centerline. A plurality of evacuation passages are defined by the injector body and extend from the armature cavity to the outer surface. The armature and the evacuation passages are positioned on opposite sides of a plane that is oriented perpendicular to the centerline.

BEST MODE FOR CARRYING OUT THE INVENTION

Figure 1:
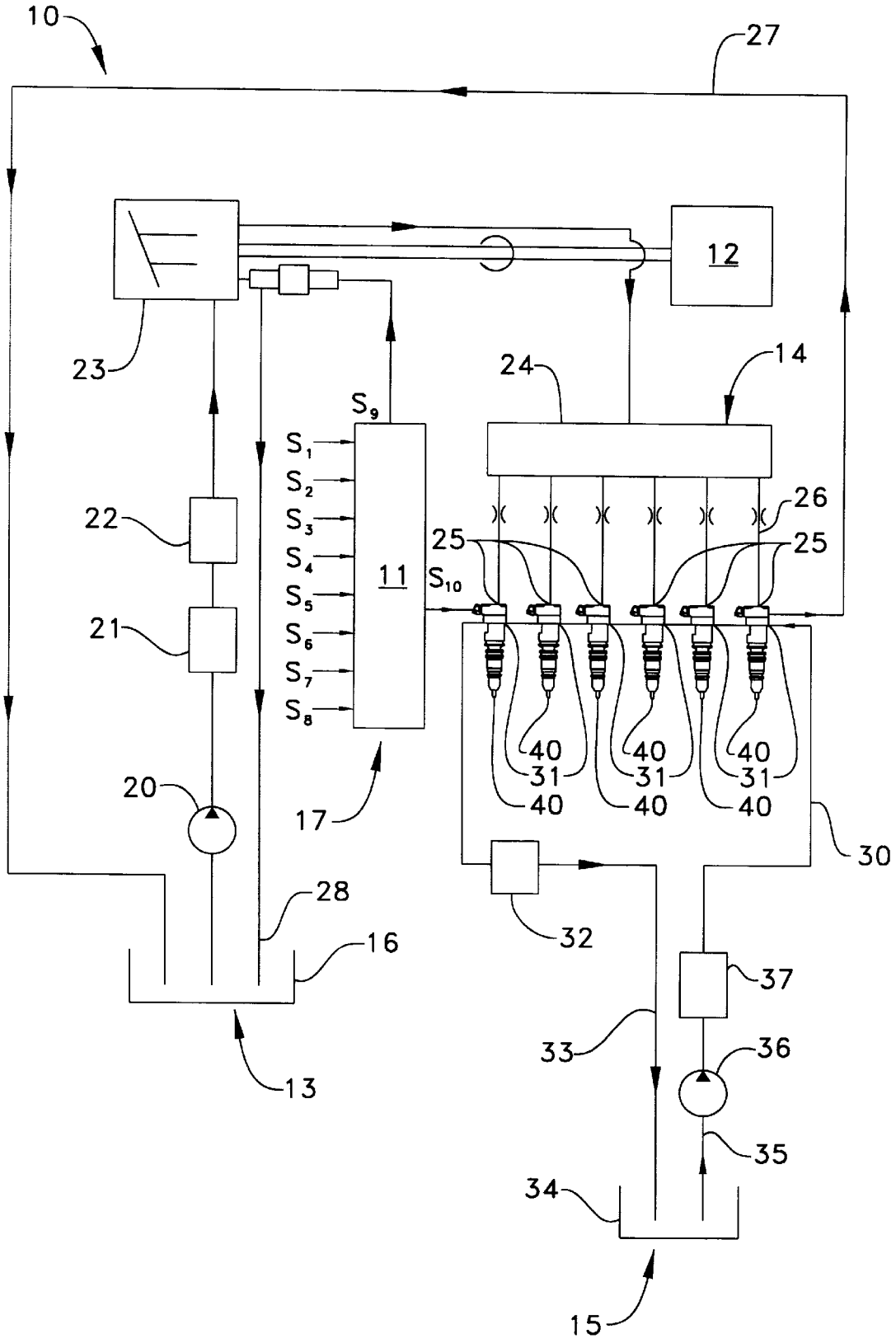
FIG. 1 is a schematic representation of a hydraulically actuated fuel injection system according to the present invention.

Referring now to FIG. 1 there is shown a schematic representation of a hydraulically actuated fuel injection system 10 as adapted for a direct injection diesel cycle internal combustion engine 12. The fuel injection system 10 includes at least one fuel injector 40, all of which are adapted to be positioned in a respective cylinder head bore of engine 12. The fuel injection system 10 also includes a low pressure actuation fluid reservoir 13 and a source of high pressure actuation fluid 14 which supplies actuation fluid to each fuel injector 40. While any available engine fluid could be used as the actuation fluid in this system, the present invention preferably utilizes engine lubricating oil. This allows fuel injection system 10 to be connected directly to the engine lubricating circuit. Also included in fuel injection system 10 is a source of fuel 15 for supplying fuel to each fuel injector 40. A computer 17 is included in fuel injection system 10 which can control timing and duration of injection events.

Actuation fluid reservoir 13 preferably includes an engine oil pan 16, an actuation fluid cooler 21, one or more actuation fluid filters 22 and a low pressure pump 20 for supplying oil or actuation fluid to fuel injection system 10. Actuation fluid reservoir 14 also preferably includes a high pressure pump 23 for generating high pressure in the actuation fluid. A high pressure branch passage 26 connects a high pressure actuation fluid inlet 25 of each fuel injector 40 to the source of high pressure actuation fluid 14, here a high pressure common rail 24. Actuation fluid exiting fuel injector 40 flows through a low pressure passage 27 and is returned to oil pan 16. A portion of high pressure actuation fluid generated by high pressure pump 23 is routed back to oil pan 16 via a pressure relief line 28 as the method by which pressure is maintained in high pressure common rail 24.

The source of fuel 15 preferably includes a fuel supply pressure regulating valve 32 and a fuel circulation and return passage 33 arranged in fluid communication between fuel injectors 40 and a fuel tank 34. Fuel is supplied to fuel injectors 40 via a fuel supply line 30 arranged in fluid communication between fuel tank 34 and the fuel inlet 31 of each fuel injector 40. Fuel being supplied through a fuel supply passage 35 travels through a low pressure fuel transfer pump 36 and one or more fuel filters 37.

Fuel injection system 10 is electronically controlled via computer 17 which includes an electronic control module 11 that controls the timing and duration of injection events via a control signal $S_{10}$. Actuation fluid pressure in high pressure common rail 24 is controlled by a control signal $S_9$. Based upon a variety of input parameters including temperature, throttle, engine load, etc. ($S_1$–$S_8$) electronic control module 11 can determine a desired injection timing duration and manifold pressure to produce some desired performance at the sensed operating conditions.

Referring now to FIGS. 2–5, there is shown a diagrammatic cross section of fuel injector 40 according to the present invention as well as a diagrammatic isometric representation of a solenoid cap 56 for use with fuel injector 40. Fuel injector 40 includes an injector body 41 made up of various components that are attached to one another in a manner well known in the art and positioned as they would be just prior to an injection event. Actuation fluid can flow into fuel injector 40 through actuation fluid inlet 25 from the source of high pressure actuation fluid 14, via high pressure branch passage 26. At the end of an injection event, actuation fluid can flow through a drain passage 57 and exit fuel injector 40 through an actuation fluid drain 18. This exiting actuation fluid can then flow through low pressure passage 27 into low pressure fluid reservoir 13. Fuel can flow into injector body 41 from fuel source 15 through fuel supply line 30, into fuel inlet 31.

Figure 2:
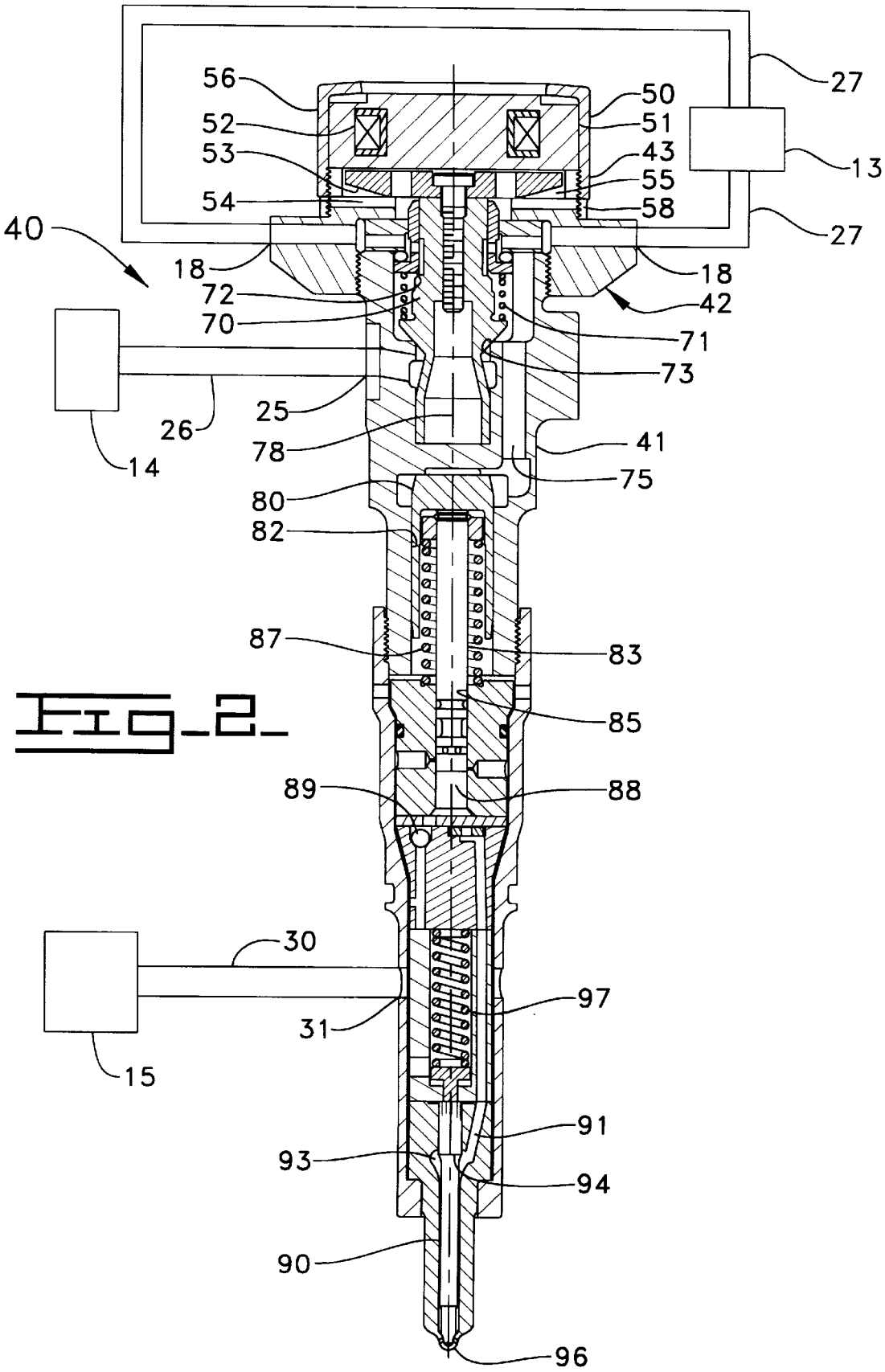
FIG. 2 is a front diagrammatic cross section of a hydraulically actuated fuel injector according to the present invention.
Figure 3:
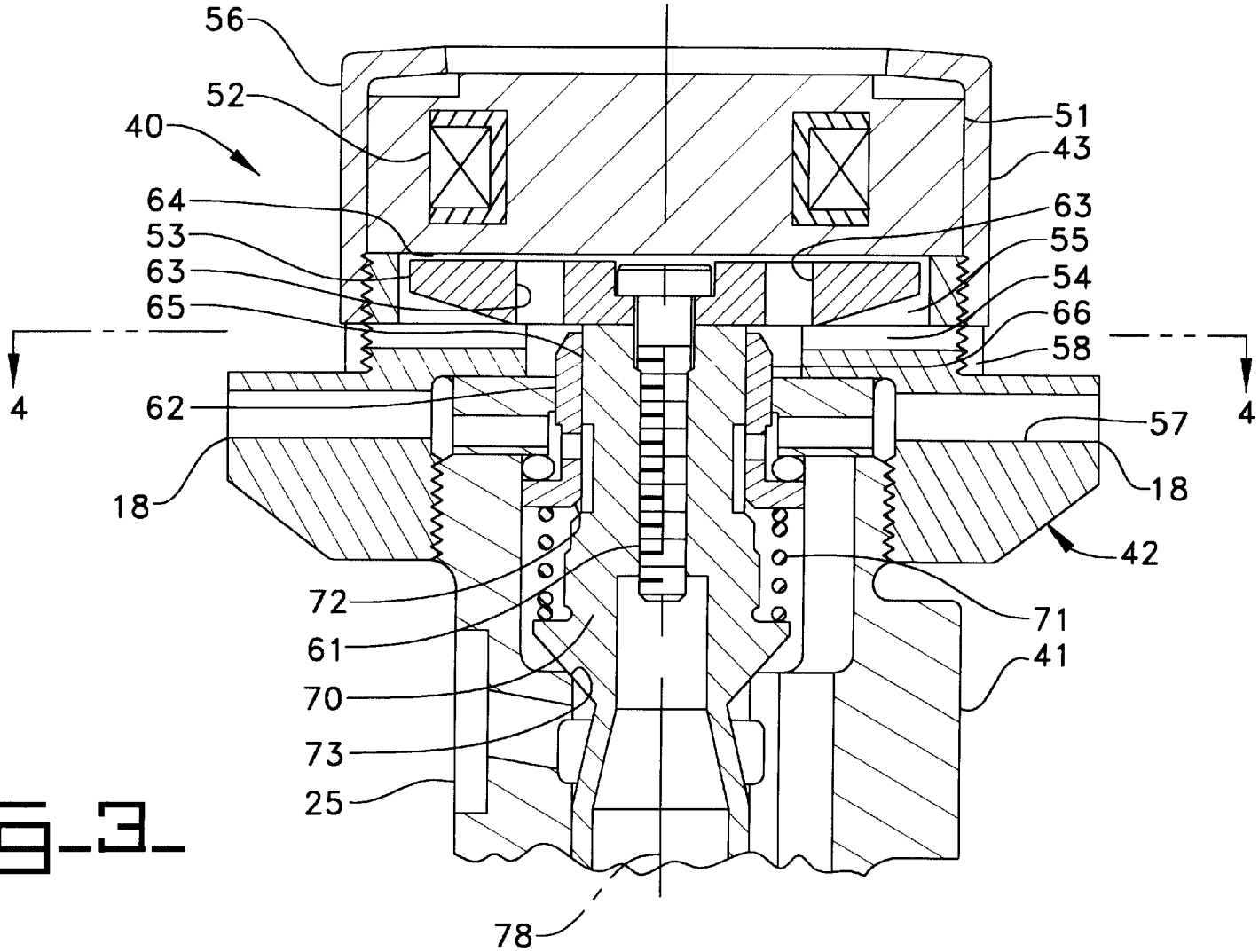
FIG. 3 is a partial front diagrammatic cross section of the fuel injector in FIG. 2.
Figure 4:
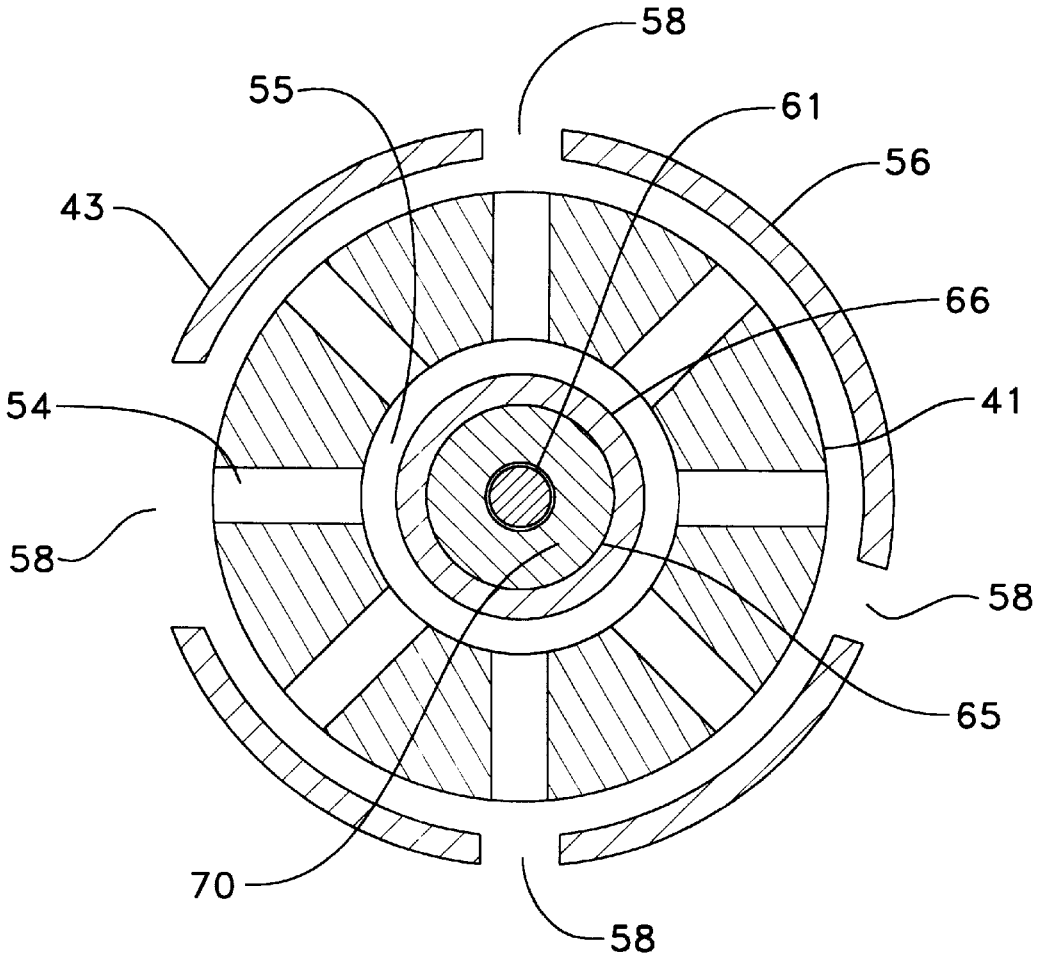
FIG. 4 is a sectioned view through the fuel injector of FIG. 2 as viewed along section lines 4—4 of FIG. 3.
Figure 5:
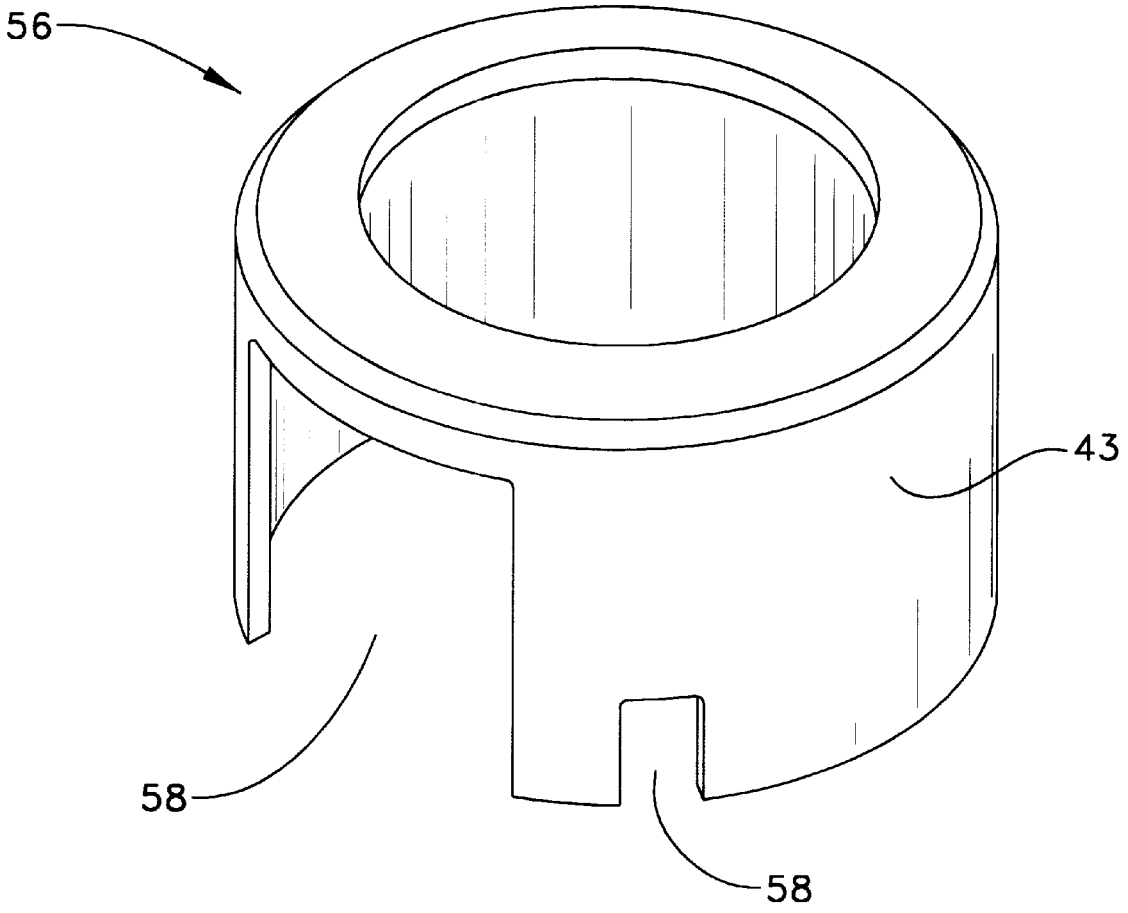
FIG. 5 is a diagrammatic isometric representation of the solenoid cap for use with the fuel injector of FIG. 2.

Fuel injector 40 is controlled in operation by a hydraulic control valve 42 which is attached to injector body 41. Control valve 42 includes an electrical actuator 50 and includes a poppet valve 70 that defines a centerline 78. Electrical actuator 50 is preferably a two position solenoid 51, as shown in FIG. 2, but it could be another suitable device such as a piezoelectric actuator. Solenoid 51 includes an armature 53 and a coil 52, which pulls armature 53 upward when solenoid 51 is energized. Armature 53 and solenoid 51 are separated by an air gap 64. As coil 52 pulls armature 53 upward during an injection event, armature 53 reduces air gap 64 as it approaches solenoid 51. Because air gap 64 is minimal in size, it should be appreciated that movement of armature 53 can be restricted if fluid migrates into that space. Therefore, armature 53 defines a number of fluid displacement holes 63 which allow fluid that has migrated into air gap 64 to be evacuated. Armature 53 is positioned within an armature cavity 55 that is defined by injector body 41 and solenoid 51. A plurality of evacuation passages are defined by injector body 41. The evacuation passages are a plurality of grooves 54 which extend from armature cavity 55 to an outer surface 43 of injector body 41.

Grooves 54 preferably slope downward as they extend radially outward from centerline 78. Armature 53 and grooves 54 are positioned in fuel injector 40 such that they are on the opposite side of a plane which is perpendicular to centerline 78. Therefore, a bottom surface of armature 53 is always located above a top surface of grooves 54. Injector body 41 preferably defines eight grooves 54 to ensure that an adequate number are in registry with a set of windows 58 (FIG. 5) defined by solenoid cap 56. In the present fuel injector 40, orientation of various grooves 54 and windows 58 is not necessarily uniform between individual fuel injectors due to the cylindrical shape of solenoid 51 and solenoid cap 56. This is unlike the Ausman fuel injectors which included no solenoid cap and had a predetermined orientation due to the square shape of the solenoid and the manner in which it was attached to the fuel injector. It should be appreciated that while the present invention has been shown to include eight grooves 54, a different number of grooves could be utilized to achieve adequate results.

Returning to fuel injector 40, control valve 42 includes a poppet valve 70 that is attached to armature 53 by a fastener 61 and is moveable between a high pressure seat 73 and a low pressure seat 72. Poppet valve 70 is biased toward high pressure seat 73 by a biasing spring 71. When poppet valve 70 is seated at high pressure seat 73, low pressure actuation fluid contained within an actuation fluid cavity 75 can exit fuel injector 40 through actuation fluid drain 18. When solenoid 51 is activated, armature 53 pulls poppet valve 70 toward low pressure seat 72 against the action of biasing spring 71. When poppet valve 70 is seated in low pressure seat 72, actuation fluid cavity 75 is open to actuation fluid inlet 25 and closed to actuation fluid drain 16, allowing high pressure actuation fluid to flow into actuation fluid cavity 75.

Poppet valve 70 is machined to have a poppet clearance 65 and is positioned in control valve 42 to move within a poppet sleeve 66. Poppet sleeve 66 is machined to have a sleeve clearance 62 with regard to the surrounding portion of injector body 41. Recall that Ausman fuel injectors relied in part on a tight poppet clearance and an o-ring in the sleeve clearance to prevent viscous oil from flowing into the armature cavity during cold start. However, because the present invention provides a means for evacuating cold oil from armature cavity 55 there is no longer a requirement for these clearances to be as tight. Because practical geometric constraints preclude inclusion of an o-ring seal between poppet sleeve 66 and the remaining portion of injector body 41, cold oil can more easily migrate into armature cavity 55 in the present invention than in the Ausman fuel injector. Therefore, the present invention includes a means for evacuating cold oil from armature cavity 55 in the form of grooves 54.

Injector body 41 also defines a piston bore 82 within which an intensifier piston 80 can move between a retracted position, as shown, and a downward advanced position. Piston 80 is biased toward its retracted position by a biasing return spring 87. Connected to piston 80 is a plunger 83 which moves within a plunger bore 85. As with piston 80, plunger 83 is biased toward its retracted position by return spring 87. Piston 80 advances due to the hydraulic pressure force exerted on its top surface.

When piston 80 begins to advance, plunger 83 advances in a corresponding fashion and acts as the hydraulic means for pressurizing fuel within injector 40. A portion of plunger bore 85 defines a fuel pressurization chamber 88 that is connected to fuel inlet 31 past a check valve 89. When plunger 83 is returning to its retracted position, fuel is drawn into fuel pressurization chamber 88 past check valve 89. During an injection event as plunger 83 moves toward its advanced position, check valve 89 is closed and plunger 83 can act to compress fuel within fuel pressurization chamber 88. While there is a possibility for leakage of fluid along moveable components within injector body 41, there is no direct fluid passage connecting fuel pressurization chamber 88 to actuation fluid cavity 75. Fuel pressurization chamber 88 is fluidly connected to a nozzle outlet 96 via a nozzle supply passage 91 and a nozzle chamber 93.

A needle valve member 90 is movably mounted in injector body 41 between a first position, in which nozzle outlet 96 is open, and a downward second position in which nozzle outlet 96 is blocked. Needle valve member 90 is mechanically biased toward its downward closed position by a biasing spring 97. Needle valve member 90 includes an opening hydraulic surface 94 which is exposed to fluid pressure in nozzle chamber 93. The strength of biasing spring 97 and the area of opening hydraulic surface 94 define a valve opening pressure. When the pressure exerted on opening hydraulic surface 94 exceeds the valve opening pressure, the pressure is then sufficient to move needle valve member 90 against the action of biasing spring 97 to open nozzle outlet 96. The fuel within fuel pressurization chamber 88 is then permitted to flow through nozzle supply passage 91 into nozzle chamber 93 and out of nozzle outlet 96. At the end of the injection event, when the fuel pressure within fuel pressurization chamber 88 drops below a valve closing pressure, needle valve member 90 returns to its biased position, closing nozzle outlet 96 and ending fuel flow into the combustion space.

INDUSTRIAL APPLICABILITY

Prior to the start of an injection event, low pressure in fuel pressurization chamber 88 prevails and actuation fluid cavity 75 is open to actuation fluid drain 16, piston 80 and plunger 83 are in their respective retracted positions, and needle valve member 90 is in its seated position closing nozzle outlet 96. The injection event is initiated by activation of solenoid 51. When solenoid 51 is activated, armature 53 pulls poppet valve 70 away from high pressure seat 73 and against the action of biasing spring 71. The movement of poppet valve 70 to low pressure seat 72 closes actuation fluid cavity 75 to actuation fluid drain 16 and opens it to actuation fluid inlet 25. Actuation fluid can now flow into actuation fluid cavity 75 from the source of high pressure actuation fluid 14, via high pressure branch passage 26. Recall that while a number of fluids could be used as actuation fluid, the present invention uses engine lubricating oil.

At cold start, lubricating oil flowing into fuel injector 40 is highly viscous. As poppet valve 70 moves within poppet sleeve 66, it is possible for cold oil to migrate into armature cavity 55. It should be appreciated that if there was no means for removing this oil from armature cavity 55, performance of solenoid 51 would be adversely affected. However, the present invention assures that any viscous oil which enters armature cavity 55 can be evacuated through grooves 54 while only minimally interfering with the injection event. The cold oil can flow from armature cavity 55 through grooves 54 and out of injector body 41 via windows 58 of solenoid cap 56. Additionally, movement of armature 53 can act as a pumping means to help evacuate oil from armature cavity 55. Because the present invention provides a means for evacuating cold, viscous oil from armature cavity 55, performance of fuel injector 40 at cold start can be closer to expected levels.

Unlike the Ausman fuel injector discussed earlier, fuel injector 40 does not include an o-ring seal between poppet sleeve 66 and the surrounding injector body 41 to prevent highly viscous oil from flowing into armature cavity 55 from actuation fluid cavity 75. While the Ausman injector provides seals and clearances from getting into the armature cavity 55, the present invention deals with this problem by providing methods for evacuating viscous oil that may migrate into armature cavity 55 at cold start. For these reasons, it should be appreciated that the present invention can help maximize performance at cold start in fuel injectors having geometrical and spatial constraints which prevent them from utilizing the previous solutions.

Returning to the injection event, pressure within actuation fluid cavity 75 begins to rise due to the high pressure oil flowing into actuation fluid cavity 75 from inlet 25 which causes a rise in the pressure acting on piston 80. The rise in pressure within actuation fluid cavity 75 begins to move piston 80 toward its advanced position against the bias of return spring 87. The downward movement of piston 80 moves plunger 83 against the bias of return spring 87, closing check valve 89 and raising the pressure of the fuel within fuel pressurization chamber 88 and nozzle supply passage 91. The increasing pressure of the fuel within nozzle supply passage 91 acts on opening hydraulic surface 94 of needle valve member 90. When the pressure exerted on opening hydraulic surface 94 exceeds a valve opening pressure, needle valve member 90 is lifted against the action of biasing spring 97, and fuel is allowed to spray into the combustion chamber from nozzle outlet 96.

Shortly before the desired amount of fuel has been injected, a signal is sent to solenoid 51 to end the injection event. Poppet valve 70 returns to high pressure seat 73 under the action of biasing spring 71. This downward movement of armature 53 can force any migrated cold oil from armature cavity 55 and out of grooves 54. Actuation fluid inlet 25 is then closed, preventing further flow of high pressure actuation fluid into actuation fluid cavity 75 from the source 14. This results in a drop in pressure within actuation fluid cavity 75, resulting in a corresponding drop in pressure acting on piston 80. The drop in pressure causes intensifier piston 80 and plunger 83 to stop their downward stroke. Because plunger 83 is no longer moving downward, the pressure of the fuel within fuel pressurization chamber 88 begins to drop. When the pressure of this fuel falls below the valve closing pressure, needle valve member 90 is pushed by biasing spring 97 toward its downward position to close nozzle outlet 96 and end the injection event.

Between injection events various components of injector body 41 begin to reset themselves in preparation for the next injection event. Because the pressure acting on piston 80 has dropped, return spring 87 moves piston 80 and plunger 83 back to their respective, retracted positions. The retracting movement of intensifier piston 80 forces the actuation fluid from actuation fluid cavity 75 through actuation fluid drain 16 into low pressure actuation fluid reservoir 13 for recirculation, via low pressure passage 27. The retracting movement of plunger 83 causes fuel from fuel inlet 31 to be pulled into fuel pressurization chamber 88 through fuel supply line 30 past check valve 89.

The present invention can improve injector performance at cold start by providing a means for evacuating cold, highly viscous oil from the armature cavity of a fuel injector. In fuel injectors having spatial and geometrical constraints that prevent them from utilizing previous solutions to prevent viscous oil from flowing into the actuation fluid cavity, there is a high probability that cold oil will migrate into the armature cavity. The present invention can prevent detrimental effects to performance from this viscous oil by utilizing a number of grooves through which cold oil can exit the injector. Further, the present invention can exploit the movement of the armature to act as a pump to aid in removal of cold oil from the armature cavity. With the viscous oil removed from the armature cavity, the injector can perform closer to expected levels at cold start.

It should be understood that the above description is intended only to illustrate the concepts of the present invention, and is not intended to in any way limit the potential scope of the present invention. For instance, while the grooves have been illustrated as sloping downward as they extend radially outward, it should be appreciated that they could instead be machined without the slope. Further, while the present invention has been shown as including eight grooves leading from the armature cavity, it should be appreciated that a different number could be utilized, so long as a sufficient number of grooves are available to be in registry with windows in the solenoid cap. Additionally, while the present invention is disclosed with radially extending grooves, it should be appreciated that other orientations can work equally well. Thus, various modifications could be made without departing from the intended spirit and scope of the invention as defined by the claims below.

What is claimed is:

1. An assembled hydraulically actuated fuel injector comprising:

an injector body including an outer surface;

a solenoid including an armature and a coil;

an armature cavity defined by said injector body and said solenoid, and said armature being positioned in said armature cavity;

a valve member defining a centerline and being positioned within said injector body and attached to said armature;

said injector body defining a plurality of evacuation passages, said evacuation passages extending from said armature cavity to said outer surface, and said armature and said evacuation passages being positioned on opposite sides of a plane which is oriented perpendicular to said centerline when said solenoid is de-energized.

2. The fuel injector of claim 1 wherein said evacuation passages are grooves that open on one side to said armature cavity.

3. The fuel injector of claim 1 wherein a portion of said evacuation passages extend radially outward relative to said centerline.

4. The fuel injector of claim 1 wherein said injector body includes a solenoid cap; and a portion of said evacuation passages being windows being defined by said solenoid cap.

5. The fuel injector of claim 1 wherein said valve member is a poppet valve which moves between a first seat and a second seat defined by said injector body.

6. The fuel injector of claim 1 wherein said solenoid and said armature have circular cross sections having centers concentrically aligned with said centerline.

7. The fuel injector of claim 1 wherein said injector body defines an inlet passage which is fluidly connected to a source of high pressure actuation fluid;

said injector body defines an outlet passage which is fluidly connected to a volume of low pressure actuation fluid; and said injector body defines a fuel inlet which is fluidly connected to a source of fuel, said fuel being a fluid different than said actuation fluid.

8. The fuel injector of claim 1 wherein said injector body includes an inlet passage fluidly connected to a source of lubricating oil.

9. An engine including a hydraulically actuated fuel injection system comprising:

an assembled hydraulically actuated fuel injector attached to said engine and defining an injector body;

said injector body including an outer surface;

a solenoid including an armature and a coil, an armature cavity defined by said injector body and said solenoid, and said armature being positioned in said armature cavity;

a valve member defining a centerline and being positioned within said injector body and attached to said armature;

said injector body defining a plurality of evacuation passages, said evacuation passages extending from said armature cavity to said outer surface; and said armature and said evacuation passages being positioned on opposite sides of a plane which is oriented perpendicular to said centerline when said solenoid is de-energized.

10. The engine and system of claim 9 wherein said centerline is vertically oriented.

11. The engine and system of claim 10 wherein a portion of said evacuation passages are grooves that open on one side to said armature cavity; and said grooves extend radially outward relative to said centerline.

12. The engine and system of claim 11 wherein said injector body includes a solenoid cap, a second portion of said evacuation passages being windows in said cap.

13. The engine and system of claim 12 wherein said solenoid and said armature have circular cross sections having centers being concentrically aligned with said centerline.

14. The engine and system of claim 13 wherein said valve member is a poppet valve which moves between a first seat and a second seat defined by said injector body.

15. The engine and system of claim 14 wherein said injector body defines an inlet passage which is fluidly connected to a source of high pressure engine lubricating oil;

said injector body defines an outlet passage which is fluidly connected to a volume of low pressure oil; and said injector body defines a fuel inlet which is fluidly connected to a source of medium pressure fuel.

16. An assembled hydraulically actuated fuel injector comprising:

an injector body defining an outer surface, a lubricating oil inlet passage, a lubricating oil drain, and a fuel inlet;

a solenoid including an armature and a coil;

an armature cavity defined by said injector body and said solenoid, and said armature being positioned in said armature cavity;

a valve member defining a centerline and being positioned within said injector body and attached to said armature;

said injector body defining a plurality of evacuation passages extending from said armature cavity to said outer surface;

said evacuation passages opening on one side to said armature cavity and extending radially outward relative to said centerline; and said armature and said evacuation passages being positioned on opposite sides of a plane which is oriented perpendicular to said centerline when said solenoid is de-energized.

17. The fuel injector of claim 16 wherein a first portion of said evacuation passages are grooves that open on one side to said armature cavity; and said injector body includes a solenoid cap, a second portion of said evacuation passages being windows in said cap.

18. The fuel injector of claim 17 wherein said first portion of said evacuation passages extend radially outward relative to said centerline.

19. The fuel injector of claim 18 wherein said injector body defines an actuation fluid cavity;

said valve member is moveable between a first position and a second position;

said lubricating oil inlet passage being open to said actuation fluid cavity when said valve member is in said first position;

said lubricating oil drain being open to said actuation fluid cavity when said valve member is in said second position; and a means for enabling an amount of lubricating oil to migrate from said actuation fluid cavity to said armature cavity.

* * * * *